US008348176B2

(12) United States Patent
Frasch et al.

(10) Patent No.: US 8,348,176 B2
(45) Date of Patent: Jan. 8, 2013

(54) FUEL INJECTOR WITH AN INTEGRATED PRESSURE BOOSTER

(75) Inventors: Juergen Frasch, Holzgerlingen (DE); Heinz-Bernd Haiser, Ludwigsburg (DE); Christoph Butscher, Leonberg (DE); Hans-Christoph Magel, Reutlingen (DE); Stephan Wehr, Heiligenstadt (DE)

(73) Assignee: Robert Bosch GmbH, Stuttgart (DE)

( * ) Notice: Subject to any disclaimer, the term of this patent is extended or adjusted under 35 U.S.C. 154(b) by 593 days.

(21) Appl. No.: 12/523,556

(22) PCT Filed: Jan. 3, 2008

(86) PCT No.: PCT/EP2008/050022

§ 371 (c)(1),
(2), (4) Date: Jul. 17, 2009

(87) PCT Pub. No.: WO2008/087052

PCT Pub. Date: Jul. 24, 2008

(65) Prior Publication Data

US 2010/0019068 A1 Jan. 28, 2010

(30) Foreign Application Priority Data

Jan. 18, 2007 (DE) ..... 10 2007 002 760

(51) Int. Cl.
*F02M 47/02* (2006.01)
*F02M 63/00* (2006.01)
*B05B 9/00* (2006.01)

(52) U.S. Cl. ..... 239/90; 239/91; 239/92; 239/124; 239/533.3; 123/447; 123/514

(58) Field of Classification Search .. 239/533.1–533.15, 239/88–92, 95, 124; 123/467, 446, 447, 123/496, 357, 514
See application file for complete search history.

(56) References Cited

U.S. PATENT DOCUMENTS

| | | | | |
|---|---|---|---|---|
| 6,161,770 | A * | 12/2000 | Sturman | 239/5 |
| 6,257,499 | B1 * | 7/2001 | Sturman | 239/96 |
| 6,453,875 | B1 * | 9/2002 | Mahr et al. | 123/446 |
| 6,811,103 | B2 * | 11/2004 | Gurich et al. | 239/533.2 |
| 2002/0017573 | A1 | 2/2002 | Sturman | |
| 2004/0046059 | A1 * | 3/2004 | Kienzler et al. | 239/533.2 |
| 2004/0168673 | A1 | 9/2004 | Shinogle | |
| 2005/0224600 | A1 | 10/2005 | Brenk et al. | |
| 2006/0097067 | A1 | 5/2006 | Buehler et al. | |
| 2006/0196474 | A1 * | 9/2006 | Magel | 123/446 |

FOREIGN PATENT DOCUMENTS

DE 102004008349 A1 9/2004

(Continued)

*Primary Examiner* — Len Tran
*Assistant Examiner* — Justin Jonaitis
(74) *Attorney, Agent, or Firm* — Michael Best & Friedrich LLP

(57) ABSTRACT

Proposed is a fuel injector for injecting fuel into a combustion chamber of an internal combustion engine. The fuel injector has a housing in which are arranged an injection valve element with a nozzle needle, a pressure boosting device, and a first control valve, and a second control valve. The first control valve controls a control space of the nozzle needle and the second control valve controls a differential pressure space of the pressure boosting device. A first return flow connection is provided for discharging the control quantity of the control space of the nozzle needle, and a second return flow connection is provided for discharging the control quantity of the pressure boosting device. The two return flow connections are arranged on different housing parts of the housing.

17 Claims, 2 Drawing Sheets

FOREIGN PATENT DOCUMENTS

| | | | |
|---|---|---|---|
| DE | 102004053421 | A1 | 5/2006 |
| EP | 1584813 | A2 | 10/2005 |
| JP | 2001502397 | A | 2/2001 |
| JP | 2006132538 | A | 5/2006 |

* cited by examiner

FUEL INJECTOR WITH AN INTEGRATED PRESSURE BOOSTER

CROSS-REFERENCE TO RELATED APPLICATION

This application is a 35 USC 371 application of PCT/EP 2008/050022 filed on Jan. 3, 2008.

BACKGROUND OF THE INVENTION

1. Field of the Invention

The invention is based on a fuel injector.

2. Description of the Prior Art

A fuel injector with an integrated pressure booster is known for instance from German Patent Disclosure DE 103 35 340 A1. The pressure booster has a pressure booster piston, guided in a housing of the fuel injector, that acts on a compression chamber, a differential pressure chamber, and a high-pressure chamber. With a first control valve, a rear control chamber of a nozzle needle is triggered, and the control volume is diverted into a low-pressure/return flow system. A second control valve connects the differential pressure chamber of the pressure booster with the low-pressure/return flow system as well. As a result of the change of pressure in the differential pressure chamber, the pressure booster piston presses into the compression chamber and compresses the fuel there, which as a result experiences a pressure increase that is transmitted to a pressure shoulder of the nozzle needle, so that the high pressure acting on the pressure shoulder lifts a nozzle needle from the nozzle needle seat and injects the fuel, at the fuel pressure elevated above the system pressure, into the combustion chamber of an internal combustion engine.

In German Patent Application DE 100 206 038 840.2, it is shown to provide one return flow connection each, for communication with the low-pressure/return flow system, for both the first control valve that triggers the nozzle needle and the second control valve that triggers the pressure booster.

Since the return flow systems for the first control valve of the nozzle needle and for the second control valve of the pressure booster are exposed to different pressure levels, and furthermore the return flow system of the pressure booster is subjected to severe pressure surges, a technologically appropriate decoupling of the two return flow circuits inside the fuel injector is necessary. In addition, a suitable disposition of the two return flow connections on the injector housing is necessary.

ADVANTAGES AND SUMMARY OF THE INVENTION

The fuel injector of the invention has the advantage that functional influence of the control valves on one another is prevented. This assures a stable quantitative performance graph of the fuel injector, which is necessary if an optimal course of injection as a function of the power demand made of the engine is to be assured. By the disposition of the two return flow connections in different housing parts of the housing, simple separation and embodiment of the two return flow connections is possible.

It is especially advantageous to embody the first return flow connection for the control quantity or for the control volume of the nozzle needle by means of at least one bore, which is extended to the outside through a first housing part, and the housing part is the nozzle lock nut, and to embody the second return flow connection for the control quantity or for the control volume of the pressure-boosting device by means of at least one further bore, which is extended to the outside through a second housing part. The second bore discharges into an annular indentation embodied on the outer wall of the housing part, and the indentation is defined by a first housing portion and a second housing portion, and there is one sealing ring each in the first housing portion and in the second housing portion.

The first control valve has a first low-pressure chamber, which communicates via a hydraulic connecting line with a first chamber that is located between the nozzle lock nut and a further housing part. The second control valve has a second low-pressure chamber, which communicates hydraulically with at least one outflow bore that leads into a second chamber, into which the further bore of the second return flow connection discharges. A leak fuel chamber, which communicates hydraulically with the first low-pressure chamber of the first control valve via hydraulic connecting lines extending through the housing, is associated with the second control valve. Advantageously, the leak fuel chamber communicates hydraulically with the second low-pressure chamber of the second control valve by means of a bypass conduit, with which a throttle restriction is integrated.

In the installed state in the internal combustion engine, each of the two return flow connections communicates with a respective return flow conduit integrated with a cylinder head of the engine, and each return flow conduit is connected to a respective low-pressure/return flow system of the engine. To that end, a stepped bore is expediently embodied in the cylinder head, and the housing of the fuel injector protrudes at least partway into this bore, and inside the stepped bore, there are two hydraulically separate portions, each with annular chambers, and the first return flow connection discharges into the one annular chamber and the second return flow portion discharges into the other annular chamber, and the annular chambers each communicate hydraulically with a respective return flow conduit.

BRIEF DESCRIPTION OF THE DRAWINGS

One exemplary embodiment of the invention is described in further detail below in conjunction with the drawings, in which.

DESCRIPTION OF THE PREFERRED EMBODIMENTS

Figure 1:
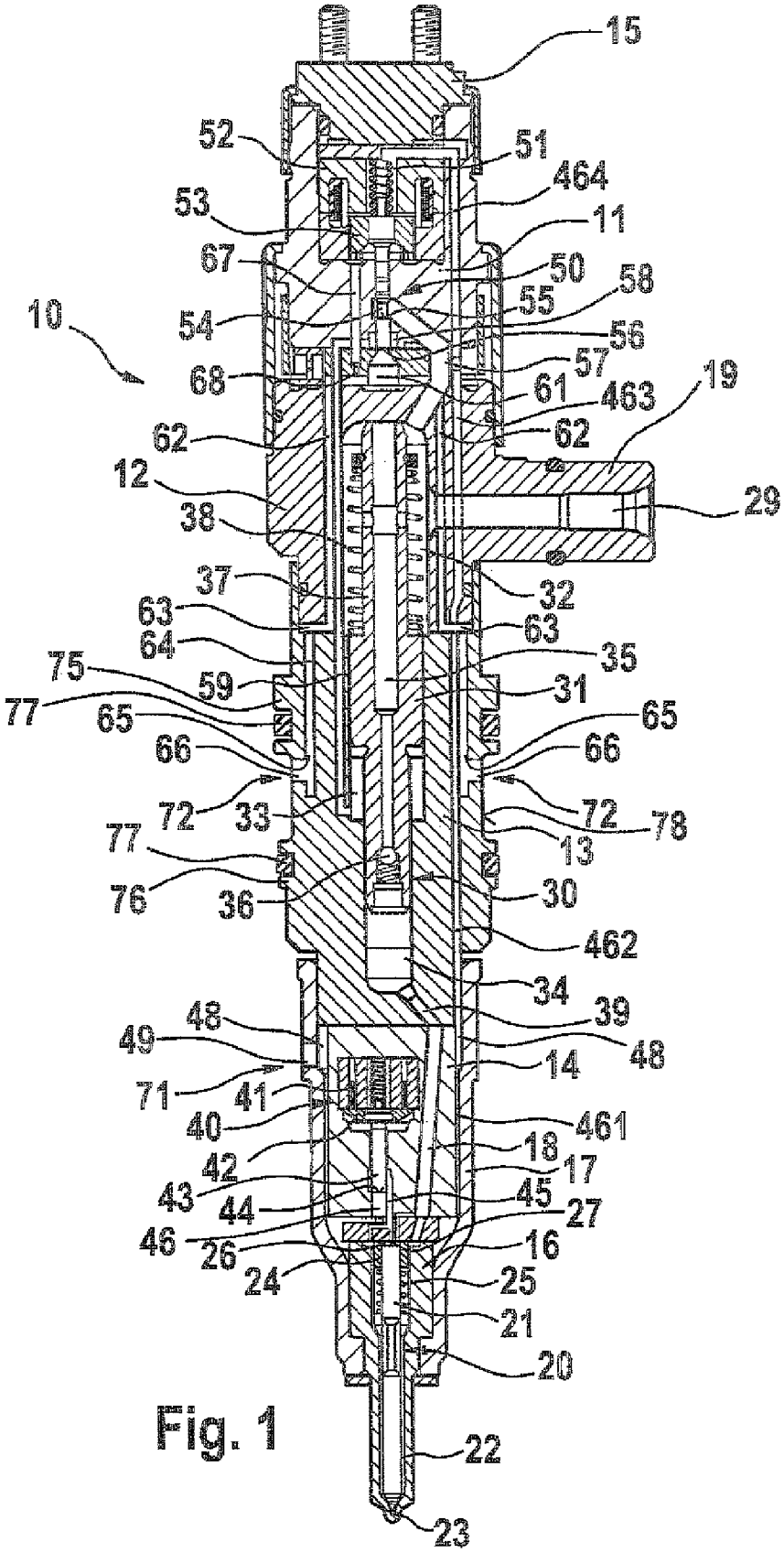
FIG. 1 is a sectional view through a fuel injector of the invention.

The fuel injector shown in FIG. 1 for instance has a housing 10 with a first housing part 11, a second housing part 12, a third housing part 13, a fourth housing part 14, and a connection part 15, as well as a nozzle body 16. The nozzle body 16, the housing part 14, and the housing part 13 are hydraulically tightly fastened by means of a nozzle lock nut 17. The nozzle body 16 contains an injection valve member 20, with a nozzle needle 21 that is axially displaceably guided in the nozzle body 16. The nozzle needle 21 cooperates with a nozzle needle seat, not shown in detail and embodied on the nozzle body 16, which with the nozzle needle 21 forms a sealing seat that in turn separates a nozzle needle pressure chamber 22 from injection openings 23, in the closed state of the nozzle needle 21. A control chamber sleeve 24 is guided on the nozzle needle 21 and a presses against a sealing face by means of a compression spring 25 and thereby surrounds a control chamber 26. With a control face 27 acting in the closing direction, the nozzle needle 21 is exposed to the control chamber 26. A high-pressure bore 18 is disposed in the housing part 14 and leads into the nozzle needle pressure chamber 22. The housing 10 has a high-pressure connection 19, for instance on the housing part 12, and has a high-pressure supply line 29 by which the fuel injector is connected to a common rail of a diesel injection system.

Also disposed in the housing 10 of the fuel injector, for boosting the system pressure of the common rail, is a pressure-boosting device 30 with a pressure booster piston 31 embodied as a stepped piston. The pressure booster piston 31 is exposed to a work chamber 32, a differential pressure chamber 33, and a compression chamber 34. The work chamber 32 and the compression chamber 34 communicate, via a connecting conduit 35, with a check valve 36. The high-pressure line 29 leads into the work chamber 32, so that the system pressure of the common rail is constantly present in the work chamber. An upper piston portion 37 of the pressure booster piston 31 also protrudes into the work chamber 32 and is surrounded by a restoring spring 38, which returns the pressure booster piston 31 to the outset position shown in FIG. 1. The upper piston portion 37 serves as a stop upon the return of the pressure booster piston 31 to the outset position. From the compression chamber 34, a further high-pressure bore 39 branches off, which communicates hydraulically with the high-pressure bore 18, so that the pressure of the compression chamber 34 is transmitted to the nozzle needle pressure chamber 22.

The fuel injector furthermore includes a first control valve 40, embodied as a servo valve, and a second control valve 50, also embodied as a servo valve. The first control valve 40 is a 2/2-way valve and includes a first electromagnetic control element 41, having a magnet armature 42 that is connected to a first valve piston 43. The valve piston 43 acts on a sealing seat 44, which separates a control bore 45, communicating with the control chamber 26, from a low-pressure chamber 46. A first low-pressure connection 461 extending out of the low-pressure chamber 46 of the first control valve 40 leads into a first annular chamber 48, which surrounds the housing part 14 and into which a bore 49 extending through the nozzle lock nut 17 leads. The bore 49 forms a first return flow connection 71, which is hydraulically in communication with a first low-pressure/return flow system.

Via the first return flow connection 71, the control quantity from the control chamber 26 of the nozzle needle 21, which quantity is switched by the first control valve 40, is carried away into the first low-pressure/return flow system, and the control quantity flows out into the low-pressure/return flow system at a substantially constant pressure level of only about 1 bar.

The second control valve 50 includes a second electromagnetic control element 52, having a second magnet armature 53 that is connected to a second valve piston 54. The valve piston 54 has a first sealing seat 55, embodied for instance as a slide seat, and a second sealing seat 56, embodied for instance as a flat seat, so that the second control valve 50 operates as a 3/2-way valve. The first sealing seat 55 separates a high-pressure line 57, communicating with the work chamber 32, from a valve chamber 58. The valve chamber 58 communicates via a hydraulic connection 59 with the differential pressure chamber 33 and is hydraulically separated from a further low-pressure chamber 61 by means of the second sealing seat 56. Two outflow bores 62, for instance, lead from the low-pressure chamber 61 to a branching chamber 63, which is in communication via further hydraulic connections 64 with a further annular chamber 65. From the annular chamber 65, bores 66, for instance two in number, extending through the housing part 13 branch off, which form a second return flow connection 72. The second return flow connection 72 is in communication with a second low-pressure/return flow system. Above the bore 66 is an upper annular housing portion 75, and below the bore 66 is a lower annular housing portion 76, each with a respective sealing ring 77. Thus between the housing portions 75, 76, an indentation 78 extending around the housing 10 is formed, into which the two bores 66 discharge. The function of the housing portions 75, 76 and the sealing rings 77 will be addressed in conjunction with FIG. 2. By way of the second return flow connection 72, the control quantity, switched by the second control valve 50, of the pressure-boosting device 30 is carried away into the second low-pressure/return flow system. The control quantity from the pressure-boosting device 30 is greater than the control quantity from the control chamber 26 and has substantially greater pressure surges.

The low-pressure chamber 46 of the first control valve 40 communicates hydraulically with a leak fuel chamber 51 of the second control valve 50 via the first low-pressure connection 461 embodied in the housing part 14, a second low-pressure connection 462 extending through the housing part 13, a third low-pressure connection 463 extending through the housing part 12, and a fourth low-pressure connection 464 embodied in the housing part 11. The leak fuel chamber 51 stretches in the second control element 52 as far as the second valve piston 54. Between the leak fuel chamber 51 and the further low-pressure chamber 61, there is a bypass conduit 67 with a throttle restriction 68, so that the two hydraulic chambers communicate in hydraulically throttled fashion.

Because of the presence of two separate return flow connections 71, 72 for the return flow of the control volume from the pressure-boosting device 30 and of the control volume from the control chamber 26 of the nozzle needle 21, it is assured that the control volume from the pressure-boosting device 30, which is burdened by major pressure surges, does not affect the first control valve 40 for triggering the nozzle needle 21.

Figure 2:
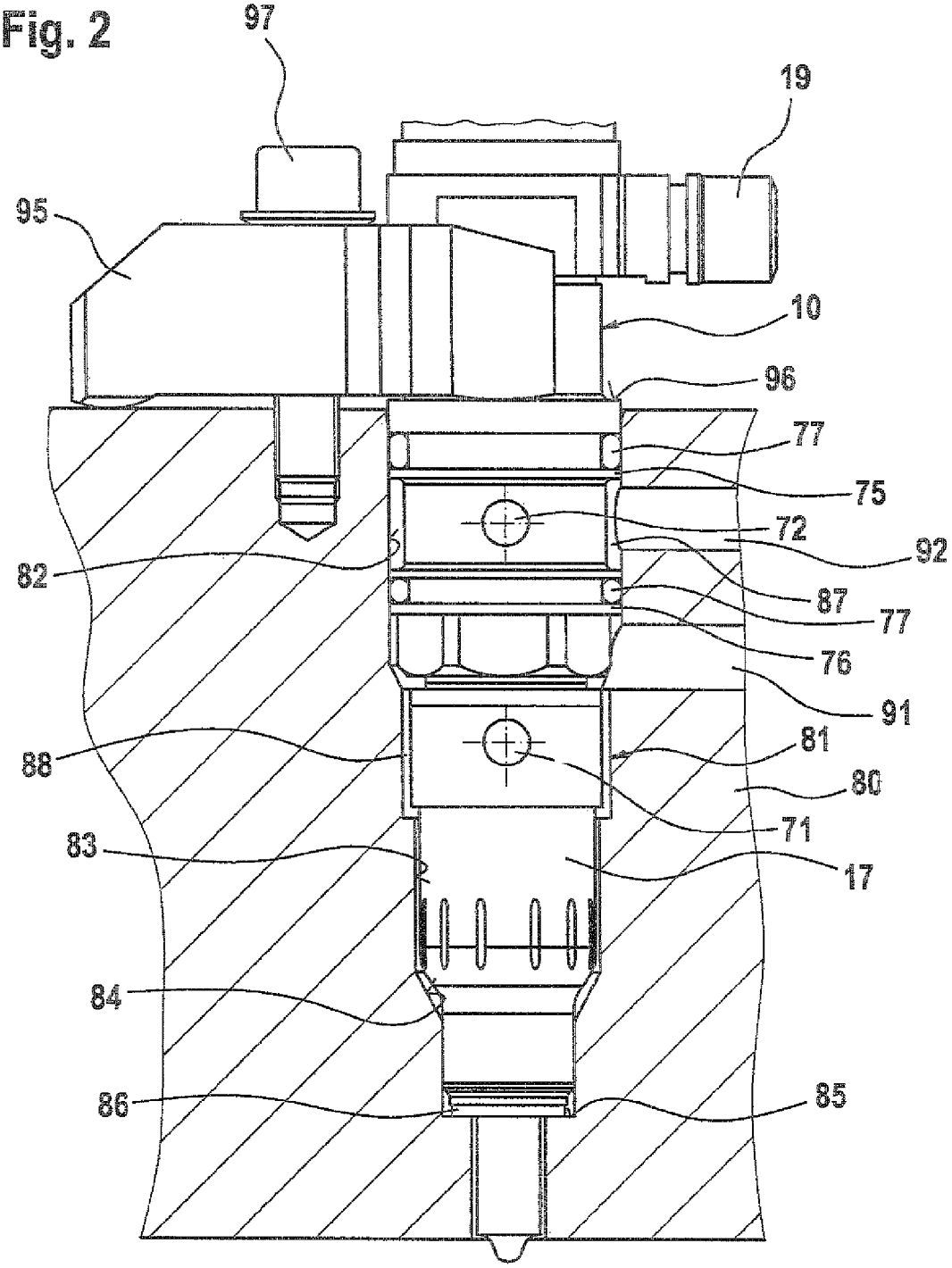
FIG. 2 is a sectional view through the fuel injector of the invention in the installed state in a cylinder head of an internal combustion engine.

FIG. 2 shows the fuel injector in the installed state in a cylinder head 80 of an internal combustion engine. The cylinder head 80 has a stepped bore 81, with a first portion 82, a second portion 83, and a third portion 84, as well as an annular contact face 85. A sealing ring 86 rests on the annular contact face 85, and the fuel injector with the nozzle lock nut 17 rests on the sealing ring. In the first portion 82, the stepped bore 81 has a first annular chamber 87, into which the second return flow connection 72 discharges. The first annular chamber 87 is hydraulically sealed off at the top and bottom by means of the respective sealing rings 77. In the second portion 83, a second annular chamber 88 is embodied, which is hydraulically sealed off at the top by the sealing ring 77 of the second housing portion 76 and at the bottom by the sealing ring 86. The first return flow connection 71 discharges into the second annular chamber 88. From the second annular chamber 88, a first return flow conduit 91 leads outward, which hydraulically connects the first return flow connections, not shown, of farther fuel injectors to one another. The first return flow conduit 91 is connected to the first low-pressure/return flow system. A second return flow conduit 92 leads into the first annular chamber 87, so that by means of the second return flow conduit 92, further, second return flow connections, not shown, of further fuel injectors are hydraulically coupled. The second return flow conduit 92 communicates hydraulically with the second low-pressure/return flow system.

The fuel injector is secured to the cylinder head 80 by means of a locking claw 95, which engages a flangelike annular face 96 on the housing 10 of the fuel injector, by means of a locking screw 97, in such a way that by means of the locking claw 95 and the sealing ring 86, a gas-tight contact of the fuel injector with the combustion chamber of the engine is created at the contact face 85.

The foregoing relates to the preferred exemplary embodiment of the invention, it being understood that other variants and embodiments thereof are possible within the spirit and scope of the invention, the latter being defined by the appended claims.

What is claimed is:

1. A fuel injector for injecting fuel into a combustion chamber of an internal combustion engine, comprising:

an injection valve member having a nozzle needle for opening and closing at least one injection opening;

a pressure-boosting device with which fuel at system pressure is compressed to injection pressure;

a first control valve and a second control valve, the first control valve controlling a control chamber of the nozzle needle, the second control valve controlling a differential pressure chamber of the pressure-boosting device;

a housing, in which the injection valve member, the pressure boosting device, the first control valve, and the second control valve, are disposed;

a high-pressure connection provided for delivering the fuel;

a first return flow connection provided for diverting a control quantity from the pressure-boosting device;

a second return flow connection provided for diverting a control quantity from a control chamber of the nozzle needle, wherein the first return flow connection and the second return flow connection are disposed on different housing parts of the housing;

wherein the first control valve has a first low-pressure chamber which communicates with a first chamber via a hydraulic connecting line, and a bore of the first return flow connection communicates with the first chamber; and wherein a leak fuel chamber associated with said second control valve communicates hydraulically with the first low-pressure chamber of the first control valve via hydraulic connecting lines extending through the housing.

2. The fuel injector as defined by claim 1, wherein the first return flow connection for the control quantity from the nozzle needle is embodied by at least one bore which is extended to the outside through a housing part disposed near the nozzle needle.

3. The fuel injector as defined by claim 2, wherein the housing part disposed near the nozzle needle is a nozzle lock nut.

4. The fuel injector as defined by claim 1, wherein the second return flow connection for the control quantity from the pressure-boosting device is embodied by at least one further bore, which is extended to the outside through a second housing part.

5. The fuel injector as defined by claim 2, wherein the second return flow connection for the control quantity from the pressure-boosting device is embodied by at least one further bore, which is extended to the outside through a second housing part.

6. The fuel injector as defined by claim 3, wherein the second return flow connection for the control quantity from the pressure-boosting device is embodied by at least one further bore, which is extended to the outside through a second housing part.

7. The fuel injector as defined by claim 4, wherein the further bore discharges into an annular indentation embodied on the outer wall of the housing part, the indentation is defined by a first housing portion and a second housing portion, and one sealing ring each is disposed in the first housing portion and in the second housing portion.

8. The fuel injector as defined by claim 5, wherein the further bore discharges into an annular indentation embodied on the outer wall of the housing part, the indentation is defined by a first housing portion and a second housing portion, and one sealing ring each is disposed in the first housing portion and in the second housing portion.

9. The fuel injector as defined by claim 6, wherein the further bore discharges into an annular indentation embodied on the outer wall of the housing part, the indentation is defined by a first housing portion and a second housing portion, and one sealing ring each is disposed in the first housing portion and in the second housing portion.

10. The fuel injector as defined by claim 2, wherein the first control valve has a first low-pressure chamber which communicates with a first chamber via a hydraulic connecting line, and the bore of the first return flow connection discharges into the first chamber.

11. The fuel injector as defined by claim 3, wherein the first control valve has a first low-pressure chamber which communicates with a first chamber via a hydraulic connecting line, and the bore of the first return flow connection discharges into the first chamber.

12. The fuel injector as defined by claim 4, wherein the second control valve has a second low-pressure chamber which communicates hydraulically with at least one outflow bore that leads into a second chamber, into which the further bore of the second return flow connection discharges.

13. The fuel injector as defined by claim 5, wherein the second control valve has a second low-pressure chamber which communicates hydraulically with at least one outflow bore that leads into a second chamber, into which the further bore of the second return flow connection discharges.

14. The fuel injector as defined by claim 12, wherein said leak fuel chamber communicates hydraulically with the second low-pressure chamber of the second control valve via a bypass conduit in which a throttle restriction is integrated.

15. The fuel injector as defined by claim 13, wherein said leak fuel chamber communicates hydraulically with the second low-pressure chamber of the second control valve via a bypass conduit in which a throttle restriction is integrated.

16. The fuel injector as defined by claim 1, wherein each of the first return flow connection and the second return flow connection communicates with a respective return flow conduit integrated with a cylinder head of the engine, and each return flow conduit is connected to a respective low-pressure/return flow system of the engine.

17. The fuel injector as defined by claim 16, wherein a stepped bore into which the housing protrudes at least partway is embodied in the cylinder head, at least two hydraulically separate portions are embodied inside the stepped bore, the first return flow connection discharges into one portion and the second return flow connection discharges into an other portion, and the portions each communicate with a respective one of the return flow conduits.

* * * * *